US008418730B2

(12) United States Patent
Kang et al.

(10) Patent No.: US 8,418,730 B2
(45) Date of Patent: Apr. 16, 2013

(54) THREE-DIMENSIONAL CELLULAR LIGHT STRUCTURES WEAVING BY HELICAL WIRES AND THE MANUFACTURING METHOD OF THE SAME

(75) Inventors: Ki Ju Kang, Chonnam (KR); Yong Hyun Lee, Kwangju (KR)

(73) Assignee: Industry Foundation of Chonnam National University (KR)

( * ) Notice: Subject to any disclaimer, the term of this patent is extended or adjusted under 35 U.S.C. 154(b) by 610 days.

(21) Appl. No.: 12/516,967

(22) PCT Filed: May 15, 2007

(86) PCT No.: PCT/KR2007/002367

§ 371 (c)(1),
(2), (4) Date: Jun. 11, 2009

(87) PCT Pub. No.: WO2008/066225

PCT Pub. Date: Jun. 5, 2008

(65) Prior Publication Data

US 2010/0071300 A1 Mar. 25, 2010

(30) Foreign Application Priority Data

Nov. 29, 2006 (KR) ..... 10-2006-0119233

(51) Int. Cl.
*B21F 27/06* (2006.01)

(52) U.S. Cl.
USPC ..... 140/5; 140/3 R; 140/92.1; 140/92.4; 140/92.6

(58) Field of Classification Search ..... 140/5, 6, 140/7, 9, 10, 12, 14, 15, 19, 25, 3 A, 3 R, 140/92.1, 92.3, 92.4, 92.5, 92.6, 93 R, 30, 140/35, 39, 45, 48
See application file for complete search history.

(56) References Cited

U.S. PATENT DOCUMENTS 347,829 A * 8/1886 De Chenne ..... 140/92.6
692,407 A * 2/1902 Wright ..... 140/92.4
(Continued)

FOREIGN PATENT DOCUMENTS

KR 1020050120175 12/2005
(Continued)

OTHER PUBLICATIONS

Wicks et al., "Sandwich Plates Actuated by a Kagome Planar Truss", ASME (2004).*

(Continued)

*Primary Examiner* — Edward Tolan
(74) *Attorney, Agent, or Firm* — Ostrolenk Faber LLP

(57) ABSTRACT

Disclosed herein is a three-dimensional cellular light structure formed of continuous wire groups. In the cellular light structure, six orientational helical wire groups are intercrossed each other at 60 degrees or 120 degrees of angles in a three-dimensional space to thereby form a uniform pattern and having a good mechanical property such as strength, rigidity or the like. A method of mass-producing the structure in a cost-effective manner is also disclosed. The three-dimensional cellular light structure has a similar form to the Kagome truss. According to the manufacturing method of the three-dimensional cellular light structure of the present invention, a frame assembly consisting of rectangular frames and connection support bars is used, when the 1st, 2nd, 3rd, 4th, 5th and 6th-axis helical wires are assembled. In addition, the manufacturing method is characterized by comprising a step of arranging and fixing the 1st, 2nd and 3rd-axis wires on the frames to form a plurality of two-dimensional Kagome planes, a step of connecting the frames by means of connection support bars, and a step of assembling the 4th, 5th and 6th-axis wires to fabricate a three-dimensional cellular light structure. When required, the intersection points of the wires are bonded by means of welding, brazing, soldering, or a liquid-or-spray-form adhesive to provide a structural material having a light weight and a good mechanical strength and rigidity, it can be made into a fiber-reinforced composite material by filling part of or entire internal empty space of the structure.

6 Claims, 20 Drawing Sheets

U.S. PATENT DOCUMENTS

| | | | | | |
|---|---|---|---|---|---|
| 2,661,029 | A | * | 12/1953 | Walsh | 140/71.5 |
| 2,711,007 | A | * | 6/1955 | Georgii | 140/1 |
| 2,986,241 | A | | 5/1961 | Fuller | |
| 3,241,577 | A | * | 3/1966 | Mallory | 140/92.5 |
| 3,298,402 | A | * | 1/1967 | Hale | 140/5 |
| 3,396,761 | A | * | 8/1968 | Laswell | 140/112 |
| 3,722,554 | A | * | 3/1973 | Vanderfaeillie | 140/115 |
| 3,749,140 | A | * | 7/1973 | Debry | 140/71 R |
| 4,590,752 | A | * | 5/1986 | Aubert et al. | 57/9 |
| 5,029,779 | A | * | 7/1991 | Bruggeman | 245/4 |
| 5,228,481 | A | | 7/1993 | Kimbara et al. | |
| 5,505,035 | A | | 4/1996 | Lalvani et al. | |
| 5,527,590 | A | * | 6/1996 | Priluck | 428/198 |
| 5,962,150 | A | * | 10/1999 | Priluck | 428/596 |
| 7,640,952 | B2 | * | 1/2010 | Khachin et al. | 140/17 |
| 2007/0095012 | A1 | | 5/2007 | Kang et al. | |

FOREIGN PATENT DOCUMENTS

| | | | |
|---|---|---|---|
| KR | 1020050120175 | A | 12/2005 |
| KR | 10-2006-0095968 | | 3/2006 |
| KR | 1020060095968 | | 9/2006 |
| WO | WO 2005/044483 | A1 | 5/2005 |

OTHER PUBLICATIONS

Wadley et al., "Fabrication and structural performance of periodic cellular metal sandwich structures", Composites Science and Technology 63 (2003).*

International Search Report dated Aug. 31, 2007, issued in corresponding international application No. PCT/KR2007/002367.

S. Hyun et al., "Simulated Properties of Kagomé and Tetragonal Truss Core Panels", *International Journal of Solids and Structures*, 2003 Elsevier Ltd., vol. 40, pp. 6989-6998.

S. Chiras et al., "The Structural Performance of Near-Optimized Truss Core Panels", *International Journal of Solids and Structures*, 2002 Elsevier Science Ltd., vol. 39, pp. 4093-4115.

D.J. Sypeck et al., "Multifunctional Microtruss Laminates: Textile Synthesis and Properties", *Journal of Materials Research*, Mar. 2001 Materials Research Society, vol. 16, No. 3, pp. 890-897.

D.J. Sypeck et al., "Cellular Metal Truss Core Sandwich Structures", *Advanced Engineering Materials*, 2002 Wiley—Vch Verlag GmbH & Co. KgaA, Weinheim, vol. 4, No. 10, pp. 759-764.

* cited by examiner

THREE-DIMENSIONAL CELLULAR LIGHT STRUCTURES WEAVING BY HELICAL WIRES AND THE MANUFACTURING METHOD OF THE SAME

CROSS REFERENCE TO RELATED APPLICATIONS

The present application is a 35 U.S.C. §371 National Phase conversion of PCT/KR2007/002367, filed May 15, 2007, which claims benefit of Korean Application No. 10-2006-0119233, filed Nov. 29, 2006, the disclosure of which is incorporated herein by reference. The PCT International Application was published in the English language.

TECHNICAL FIELD

The present invention relates to a three-dimensional cellular light structure formed of continuous wire groups and a method of manufacturing the same. More particularly, the present invention relates to a three-dimensional light structure similar to an ideal Kagome truss structure having greatly improved mechanical properties such as strength and rigidity, and a method of mass-producing the same in a cost-effective manner.

BACKGROUND ART

Conventionally, a metal foam has been known as a material similar to a cellular light structure. The metal foam is manufactured by producing bubbles inside a metal of liquid or semi-solid state (closed cell-type), or by casting the metal into a mold made of a foaming resin such as sponge (open cell-type). However, these metal foams have relatively poor mechanical properties such as strength and rigidity. In addition, due to its high manufacturing cost, it has not been used widely in practice, except for a special purpose such as in aerospace or aviation industries.

As a substitute material for the above mentioned metal foams, open cell-type light structures with periodic truss cells have been suggested. This open cell-type light structure is designed so as to have an optimum strength and rigidity through precise mathematical and mechanical analysis, and therefore it has good mechanical properties. A typical truss structure is exemplified by the Octet truss where regular tetrahedrons and regular octahedrons are combined (See R. Buckminster Fuller, 1961, U.S. Pat. No. 2,986,241). Each element of the truss forms an equilateral triangle and thus it is advantageous in terms of strength and rigidity. Recently, as a modification of the Octet truss, the Kagome truss has been reported (See S. Hyun, A. M. Karlsson, S. Torquato, A. G. Evans, 2003, Int. J. of Solids and Structures, Vol. 40, pp. 6989-6998).

Referring to FIG. 1, when the two-dimensional Octet truss 101 and the two-dimensional Kagome truss 102 are compared, a unit cell 102*a* of the Kagome truss 102 has an equilateral triangle and a regular hexagon mixed in each face, dissimilar to a unit cell 101*a* of the Octet truss 101.

FIGS. 2 and 3 show a single layer of the three-dimensional Octet truss 201 and the three-dimensional Kagome truss 202, respectively. Comparing a unit cell 201*a* of the three-dimensional Octet truss 201 with a unit cell 202*a* of the three-dimensional Kagome truss 202, one of the significant features of the three-dimensional Kagome truss 202 is that it has low anisotropic. Therefore, the structural materials or other materials based on the Kagome truss 202 have almost a uniform mechanical and electrical property regardless of its orientation.

Several processes have been used for manufacturing a truss-type cellular light structure. First, a truss structure is formed of a resin, and a metal is cast using the truss structure as a mold, i.e., investment casting (See S. Chiras, D. R. Mum, N. Wicks, A. G. Evans, J. W. Hutchinson, K. Dharmasena, H. N. G. Wadley, S. Fichter, 2002, International Journal of Solids and Structures, Vol. 39, pp. 4093-4115). Second, a metallic mesh is formed by punching periodic holes in a thin metal plate, and a truss layer is formed by bending the metallic mesh. Then, face sheets are bonded to the upper and lower portions of the truss layer as a core of a sandwich panel (See D. J. Sypeck and H. N. G. Wadley, 2002, Advanced Engineering Materials, Vol. 4, pp. 759-764). Here, in the case where a two-layered structure is to be fabricated, another truss intermediate layer is placed on the upper face sheet and another upper face sheet is positioned again thereon. By repeating the same procedure, multi-layered structure can be fabricated. In the third method, wire nets are first woven using two orientational wires perpendicular to each other, and then the wire nets are laminated and bonded (See D. J. Sypeck and H. G. N. Wadley, 2001, J. Mater, Res., Vol. 16, pp. 890-897).

As for the first method, its complicated manufacture process leads to a high manufacture cost. Only metals having a good castability can be applied and consequently it has limited applications. The resultant material tends to have casting defects and deficient strength. As for the second method, the process punching periodic holes in thin metal plate leads to loss of material. Moreover, even though there is no specific problem in manufacturing a sandwiched plate having a single-layered truss, the truss cores and face sheets must be laminated and bonded repeatedly so as to manufacture a multi-layered structure, thereby producing many bonding points which results in disadvantages in terms of bonding cost and strength.

As for the third method, basically the formed truss has no ideal regular tetrahedron or pyramid shape and thus has an inferior mechanical strength. Similar to the second method, lamination and bonding are must be involved for manufacturing a multi-layered structure and therefore disadvantageous in respect of bonding cost and strength.

FIG. 4 shows a light structure manufactured by the third method, which is formed by laminating wire nets. This method is known to be able to reduce the manufacturing cost, but wires of two orientations are woven like fabrics, and therefore it cannot provide an ideal structure having as good mechanical strength as in the above-described three-dimensional Octet truss 201 or the three-dimensional Kagome truss 202. Accordingly, it has disadvantages in terms of the cost and the strength, due to lots of portions to be bonded.

Meanwhile, a common fiber reinforced composite material is manufactured in the form of thin two-dimensional layer, which is laminated when a thick material is required.

However, in this case, due to delamination phenomenon between the layers, its strength tends to be deteriorated. In order to prevent the delamination, the fiber is woven into a three-dimensional structure from the beginning, and then a matrix such as resin, metal, or the like is combined with the structure. FIG. 5 shows a perspective view of the woven fibers in this three-dimensional fiber reinforced composite material. Instead of fibers, a material such as a metallic wire having a high stiffness can be woven into a three-dimensional cellular light structure as shown in FIG. 5. However, it also does not have the above-described ideal Octet or Kagome truss structure, and it has a decreased mechanical strength and more anisotropic material properties. Consequently, the composite material formed of the three-dimensional woven-fibers comes to have inferior mechanical properties.

In view of the aforementioned shortcomings, the inventors of the present invention have devised a three-dimensional cellular light structure which is manufactured in a uniform pattern similar to the ideal Kagome truss or Octet truss by intercrossing six-axial continuous wire groups at 60 degrees or 120 degrees of angles in a space, and a manufacturing method thereof, which is disclosed in Korean Patent Publication No. 10-2006-0095968 (hereinafter, earlier-filed invention).

The three-dimensional cellular light structure manufactured according to the earlier-filed invention has several advantages in that it has good mechanical properties and can be mass-produced in a cost-effective manner through continuous processes, over the conventional methods. The inventors have made an earnest study for improving mechanical properties relating to the rigidity and the strength of the three-dimensional cellular light structure, together with high efficiency, low cost and mass-productivity in weaving method, and finally accomplished the present invention.

[Disclosure]

[Technical Problem]

The present invention has been made to solve the above problems occurring in the prior art. It is an object of the invention to provide a Kagome truss-type three-dimensional light structure formed of six-axial continuous helical wire groups intercrossed at 60 degrees or 120 degrees in a space, wherein the three-dimensional light structure can be easily manufactured in a uniform pattern through continuous processes comprising a step of forming a plurality of two-dimensional Kagome planes consisting of 1st, 2nd and 3rd-axis helical wires and a step of assembling 4th, 5th and 6th-axis helical wires in out-of plane directions on two-dimensional Kagome planes consisted of the 1st, 2nd and 3rd-axis wires, and wherein close contact structure among the wires can be realized to thereby improve the mechanical properties such as strength, rigidity or the like. It is another object of the invention to provide a method of mass-producing the three-dimensional light structure in a cost-effective manner.

The three-dimensional light structure according to the present invention is manufactured in such a manner that a continuous wire is directly woven into a three-dimensional structure, not in the manner that planar wire-nets are simply laminated and bonded. Therefore, the cellular light structure of the invention is very similar to the ideal Kagome truss, and thus exhibits a good mechanical and electrical property.

[Technical Solution]

The features of the present invention for attaining the aforementioned objects are as follows.

(1) A three-dimensional cellular light structure manufactured by assembling 1st, 2nd, 3rd, 4th, 5th and 6th-axis wires in three-dimensional space, wherein the 1st, 2nd, 3rd, 4th, 5th and 6th-axis wires have a helical shape, and wherein the 1st, 2nd and 3rd-axis wires are assembled to form a plurality of two-dimensional Kagome planes and the 4th, 5th and 6th-axis wires are assembled in out-of plane directions on two-dimensional Kagome planes consisted of the 1st, 2nd and 3rd-axis wires.

(2) The three-dimensional cellular light structure, wherein the 1st, 2nd and 3rd-axis wires are assembled to form the two-dimensional Kagome planes of A, B and C layers in sequence from the bottom, and the wires in one layer are arranged to be constantly shifted from the wires on adjacent layers so as to maintain position deviations in horizontal and vertical directions with respect to the adjacent layers.

(3) The three-dimensional cellular light structure, wherein the wires in each layer are arranged to maintain a horizontal deviation $l_x$ and a vertical deviation $l_y$ between two adjacent layers, and the wires in each layer form the two-dimensional Kagome planes.

(4) The three-dimensional cellular light structure, wherein the two-dimensional Kagome planes of the A, B and C layers are repeatedly laminated in a manner of A, B, C, A, B, C, . . . , while maintaining prescribed distance between two adjacent layers.

(5) A method of manufacturing a three-dimensional cellular light structure, the method comprising:

a helical wire forming step of forming 1st, 2nd, 3rd, 4th, 5th and 6th-axis helical wires;

a two-dimensional Kagome plane forming step of forming a plurality of two-dimensional Kagome planes by assembling the 1st, 2nd and 3rd-axis helical wires on frames of a frame assembly;

a frame laminating step of connecting and laminating the frames by means of connection support rods; and a step of fabricating a three-dimensional cellular light structure by assembling the 4th, 5th and 6th-axis helical wires into the 1st, 2nd, and 3rd-axis helical wires in each frame.

[Advantageous Effects]

According to the present invention relating to a three-dimensional cellular light structure and a method of manufacturing the same, the 1st, 2nd and 3rd helical wires are assembled on frames to form a plurality of two-dimensional Kagome planes, the 4th, 5th and 6th wires are assembled with the wires in the two-dimensional Kagome planes to form the three-dimensional cellular light structure. Therefore, the three-dimensional cellular light structure consisting of continuous wires can be easily manufactured, thereby enabling a mass production and cost-down.

In addition, since the continuous wires of the three-dimensional cellular light structure of the present invention have a helical shape, the three dimensional cellular light structure can be assembled by rotating insertion of the helical-shaped wires and also close contacts between the wires are enhanced without causing any damage to the intended truss structure. Accordingly, desired mechanical properties can be ensured even if the three-dimensional cellular light structure is not further subject to post-processing such as welding, brazing, soldering, liquid, or the like.

DESCRIPTION OF DRAWINGS

FIG. 6 is a plane view of a wire-woven network formed of three axial-parallel wire groups and similar to the two-dimensional Kagome truss in FIG. 1.

FIG. 7 is a perspective view of a unit cell corresponding to the portion A in FIG. 6 when the two-dimensional structure of FIG. 6 is transformed into a structure similar to the three-dimensional Kagome truss in FIG. 3;

FIG. 8 is a perspective view of a unit cell of the Kagome truss of FIG. 3, which is formed of six-axial wires;

FIG. 9 is a perspective view showing a three-dimensional cellular structure of Kagome truss type, which is formed of six-axial wire groups;

FIG. 10 is a perspective view of the structure of FIG. 9 as seen from different angles;

FIG. 11 is a perspective view of a vertex of the regular tetrahedron formed by three-axial wire groups in the structure of FIG. 9, which is seen from the front of the vertex;

FIG. 12 is a perspective view of unit cells formed by a different wire-intercrossing mode in FIG. 11;

FIG. 13 is a picture of a helical wire;

FIG. 14 is a picture of a plurality of wires formed in a helical shape;

FIG. 15 is a picture of a twisting machine for forming the helical wire;

FIG. 16 is a picture of helical wires for the 1st, 2nd, 3rd, 4th, 5th, and 6th-axes;

FIG. 17 is a picture of a frame assembly for assembling the helical wires;

FIG. 18 is a picture showing the 1st, 2nd and 3rd-axis wires assembled on a frame of the frame assembly to form the two-dimensional Kagome plane;

FIG. 19 is a picture showing two layers of the two-dimensional Kagome planes assembled on frames of the frame assembly;

FIG. 20 is a picture showing the 4th, 5th and 6th-axis wires assembled with the two-dimensional Kagome planes;

FIG. 21 is a picture of a completed three-dimensional cellular light structure with the frames removed;

FIG. 22 is a plane view of the assembled 1st and 2nd-axis wires;

FIG. 23 is a plane view showing the step of assembling the 3rd-axis wires;

FIG. 24 is a plane view of a single layer of the two-dimensional Kagome plane formed of the 1st, 2nd and 3rd-axis wires;

FIGS. 25 and 26 are a plane view and a picture showing the single layer of the two-dimensional Kagome plane assembled to the frame;

FIG. 27 is a plane view showing a method of laminating the two-dimensional Kagome planes of A, B, C layers;

FIGS. 28 and 29 are a perspective view and a picture showing two layers of the two-dimensional Kagome plane with the frames;

FIG. 30 is a perspective view of two layers of the two-dimensional Kagome plane with the frames removed;

FIG. 31 is a perspective view of three layers of the two-dimensional Kagome plane with the frames;

FIG. 32 is a perspective view of three layers of the two-dimensional Kagome plane with the frame removed;

FIG. 33 is a plane view and a side view showing the step of assembling the 4th-axis wires with the 1st, 2nd and 3rd-axis wires in the two-dimensional Kagome planes;

FIG. 34 is a plane view and a side view showing the step of assembling the 5th-axis wires with the 1st, 2nd, and 3rd-axis wires in the two-dimensional Kagome plane;

FIG. 35 is a plane view and a side view showing the step of assembling the 6th-axis wires with the 1st, 2nd, and 3rd-axis wires in the two-dimensional Kagome plane;

FIG. 36 is a perspective view showing the step of assembling the last wire of the six axes wires;

FIG. 37 is a perspective view showing the step of assembling the last wire of the six axes wires, when seen from a moving direction of the last wire;

FIG. 38 is a perspective view of the final structure after the 1st, 2nd, 3rd, 4th, 5th and 6th-axis wires are completely assembled;

FIGS. 39 and 40 are pictures of the final structure after the 1st, 2nd, 3rd, 4th, 5th and 6th-axis wires are completely assembled;

MODE FOR INVENTION

The features of the present invention for attaining the aforementioned objects are as follows.

(1) A three-dimensional cellular light structure manufactured by assembling 1st, 2nd, 3rd, 4th, 5th and 6th-axis wires in three-dimensional space, wherein the 1st, 2nd, 3rd, 4th, 5th and 6th-axis wires have a helical shape, and wherein the 1st, 2nd and 3rd-axis wires are assembled to form a plurality of two-dimensional Kagome planes and the 4th, 5th and 6th-axis wires are assembled in out-of plane directions on two-dimensional Kagome planes consisted of the 1st, 2nd and 3rd-axis wires.

(2) The three-dimensional cellular light structure, wherein the 1st, 2nd and 3rd-axis wires are assembled to form the two-dimensional Kagome planes of A, B and C layers in sequence from the bottom, and the wires in one layer are arranged to be constantly shifted from the wires on adjacent layers so as to maintain position deviations in horizontal and vertical directions with respect to adjacent layers.

(3) The three-dimensional cellular light structure, wherein the wires in each layer are arranged to maintain a horizontal deviation $l_x$ and a vertical deviation $l_y$ between two adjacent layers, and the wires in each layer form the two-dimensional Kagome planes.

(4) The three-dimensional cellular light structure, wherein the two-dimensional Kagome planes of the A, B and C layers are repeatedly laminated in a manner of A, B, C, A, B, C, . . . , while maintaining prescribed distance between two adjacent layers.

(5) A method of manufacturing a three-dimensional cellular light structure, the method comprising:

a helical wire forming step of forming 1st, 2nd, 3rd, 4th, 5th and 6th-axis helical wires;

a two-dimensional Kagome plane forming step of forming a plurality of two-dimensional Kagome planes by assembling the 1st, 2nd and 3rd-axis helical wires on frames of a frame assembly;

a frame laminating step of connecting and laminating the frames by means of connection support rods; and a step of fabricating a three-dimensional cellular light structure by assembling the 4th, 5th and 6th-axis helical wires into the 1st, 2nd and 3rd-axis helical wires in each frame.

Hereafter, the earlier-filed invention (Korean Patent Publication No. 10-2006-0095968) is first described by referring to FIGS. 6 through 12 and 41 to facilitate the understanding of the present invention, and then an embodiment of the present invention will be explained.

Figure 1:
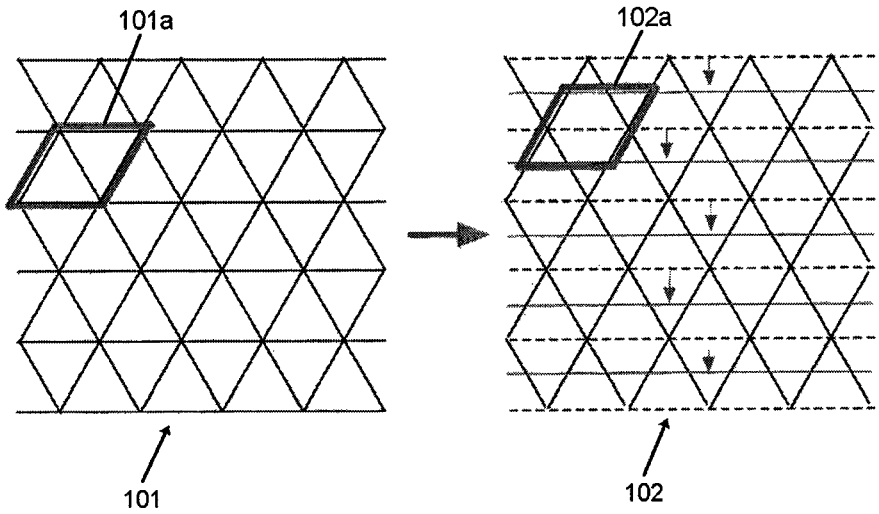
FIG. 1 is a two-dimensional view comparing the conventional two truss structure, i.e., the Octet truss and Kagome truss.
Figure 2:
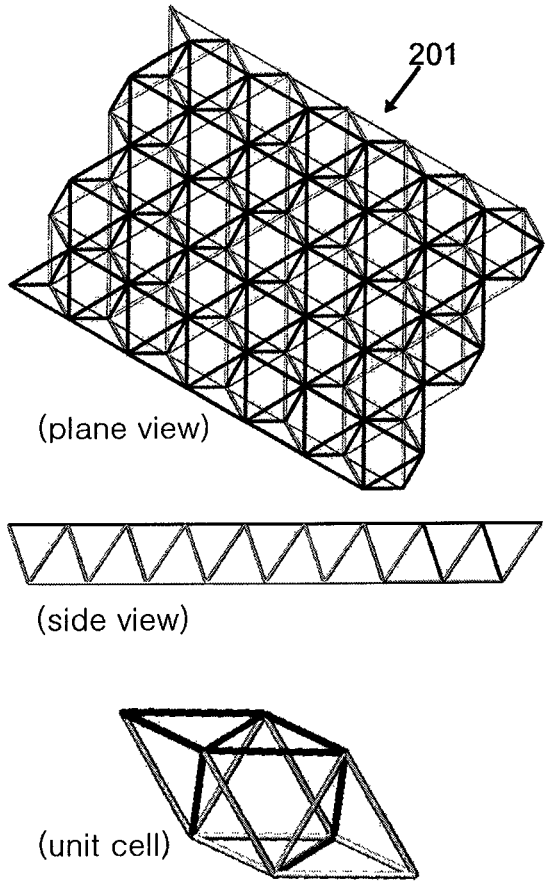
FIG. 2 shows a plane view and a side view of a single layer in the conventional three-dimensional Octet truss, and a perspective view of a unit cell thereof.
Figure 6:
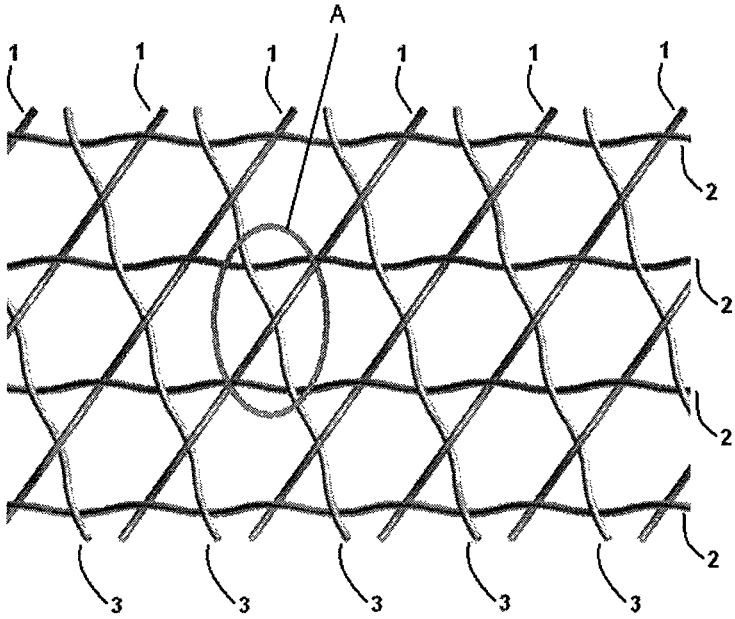
FIGS. 6 through 12 are views for illustrating the earlier-filed invention of the present invention.
Figure 7:
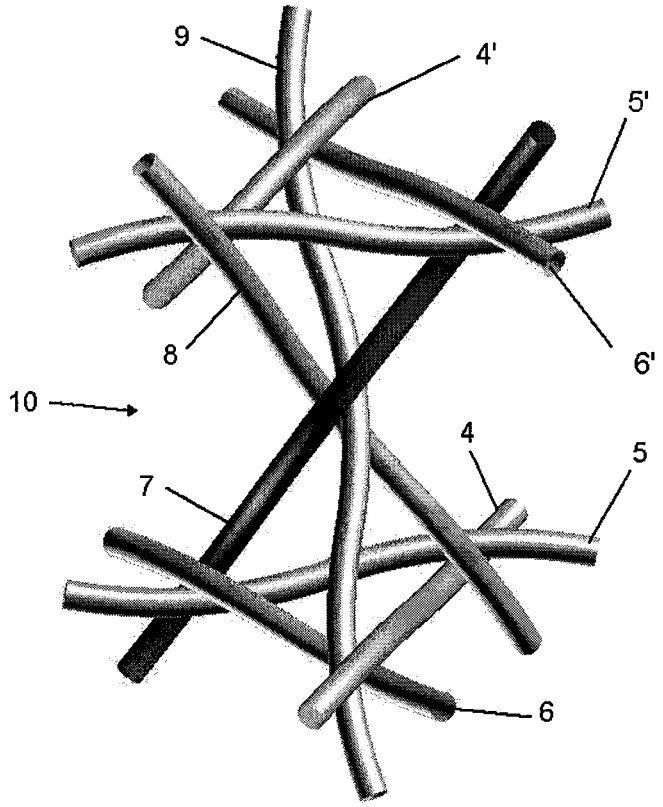

As for a structure of a three-dimensional cellular light structure, FIG. 6 shows the two-dimensional Kagome truss constructed by three-axial wire groups 1, 2 and 3, which is similar to the two-dimensional Kagome truss shown on the right side in FIG. 1. In the two-dimensional Kagome truss woven with the wire groups 1, 2, and 3 in three axes, two lines are intercrossed at intersection points at 60 degrees or 120 degrees. Since each element constituting the Kagome truss is replaced with a continuous wire, the structure is substantially similar to the ideal Kagome truss, except that the continuous wire makes a curvature while intercrossing each intersection point thereof. FIG. 7 is a three-dimensional view of the portion marked by A in FIG. 6. The equilateral triangles facing each other are transformed to the regular tetrahedrons, and three wires, rather than two wires, are intercrossed at the intersection point at 60 degrees or 120 degrees. This structure is constructed by six-axial wire groups 4, 5, 6, 7, 8, and 9, which are disposed so as to have the same orientation angle in the three-dimensional space.

The unit cell composed of the six-axial wire groups 4, 5, 6, 7, 8, and 9 comprises two regular tetrahedrons having the similar shape, which are symmetry about a common vertex and facing each other. The structure of the unit cell will be described in detail below.

The wire groups 4, 5, and 6 are intercrossed with each other in the same plane (X-Y plane) so as to constitute an equilateral triangle. The wire 7 intercrosses the intersection point of the wire 5 and the wire 6; the wire 8 intercrosses the intersection point of the wire 4 and the wire 5; and the wire 9 intercrosses the intersection point of the wire 6 and the wire 4. Here, the wire groups 6, 9, and 7 are intercrossed with each other to form an equilateral triangle; the wire groups 4, 8, and 9 are intercrossed with each other to form an equilateral triangle; and the wire groups 5, 7, and 8 are intercrossed with each other to form an equilateral triangle.

Accordingly, the six axes wire groups 4, 5, 6, 7, 8 and 9 constitute one regular tetrahedron (a first regular tetrahedron).

Other wire groups 4', 5', and 6' are provided in such a way as to place above the vertex (reference vertex) of the first regular tetrahedron, which is formed by intercrossing of the wire groups 7, 8 and 9 located above the X-Y plane in which the wire groups 4, 5 and 6 are intercrossed with one another. Other wire groups 4, 5 and 6 having the same orientations as the wire groups 4, 5 and 6 are disposed such that each of them intercrosses two wires selected from the wire groups 7, 8 and 9 to thereby form an equilateral triangle. Accordingly, the wire groups 4', 5', 6', 7, 8 and 9 form another regular tetrahedron (a second regular tetrahedron). As a result, the unit cell of the three-dimensional cellular light structure 10 is composed of the regular tetrahedron (the first regular tetrahedron) formed by the wire groups 4, 5, 6, 7, 8 and 9 and the regular tetrahedron (the second regular tetrahedron) formed by the wire groups 4', 5', 6', 7, 8 and 9. The first and second regular tetrahedrons are constructed respectively at the upper and lower side of the intersection point formed by the wire groups 7, 8 and 9 and faced with each other.

In order to form a plurality of the unit cells 10 in a three-dimensional continuous pattern, the wires are disposed such that an opposing regular tetrahedron can be constructed at each of other vertexes of the regular tetrahedron, which is formed by the wire groups 4, 5, 6, 7, 8 and 9. Therefore, a three-dimensional cellular light truss-structure can be constructed in such a manner that the above unit cell is repeatedly formed and combined in the three-dimensional space.

Figure 3:
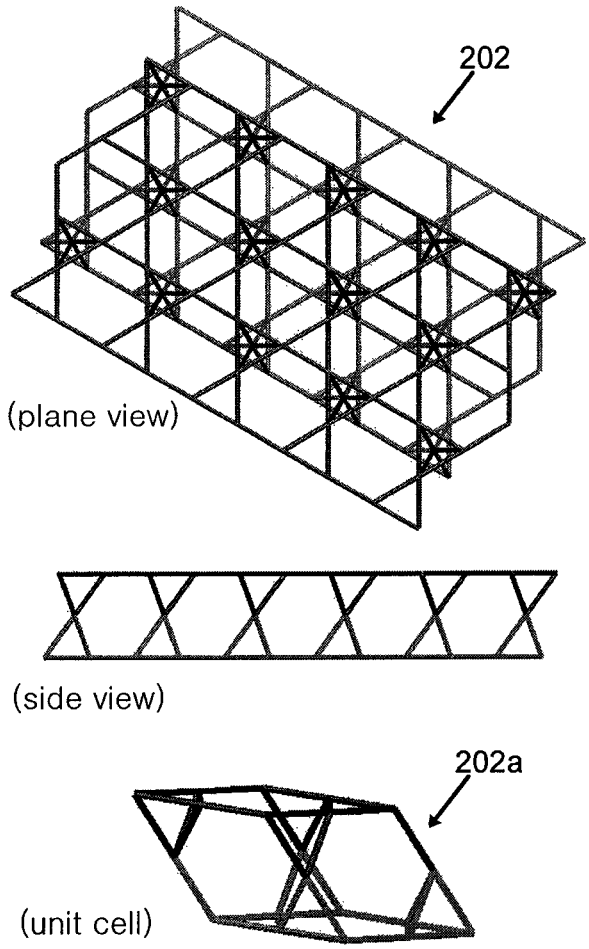
FIG. 3 shows a plane view and a side view of a single layer of the conventional three-dimensional Kagome truss, and a perspective view of a unit cell thereof.
Figure 4:
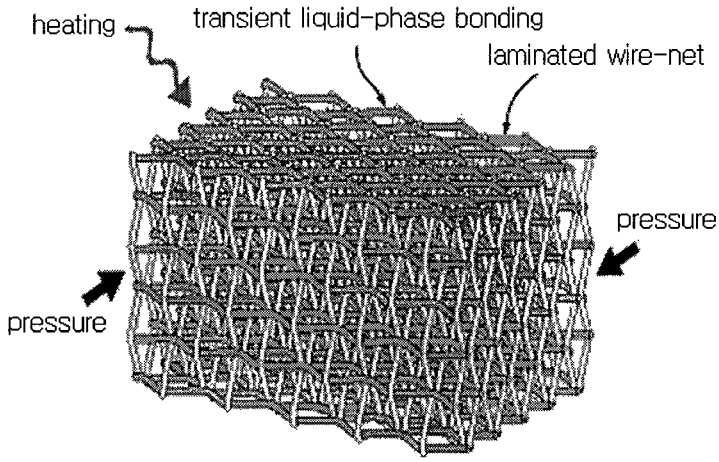
FIG. 4 is a perspective view of a light structure manufactured by laminating wire nets according to the conventional method.
Figure 5:
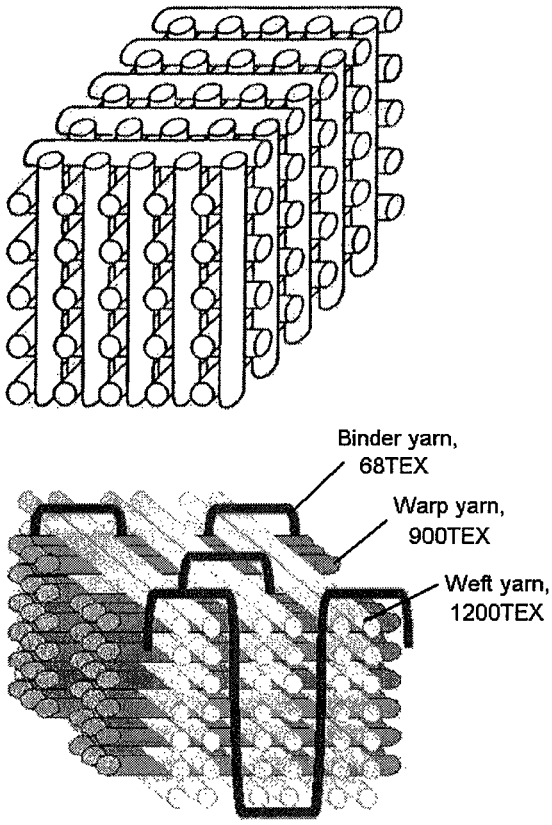
FIG. 5 is a perspective view and a detailed view showing a three-dimensional fiber reinforced composite material fabricated by weaving a fiber according to the conventional method.
Figure 8:
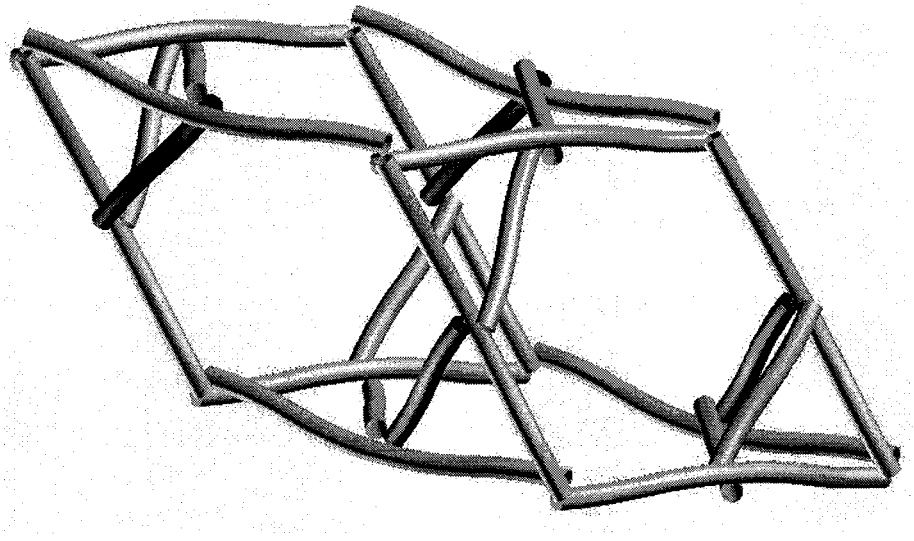

In this way, a unit cell similar to the unit cell of the three-dimensional Kagome truss shown in FIG. 3 can be constructed through above-described wire arrangement of six axial wires, which is shown in FIG. 8.

Figure 9:
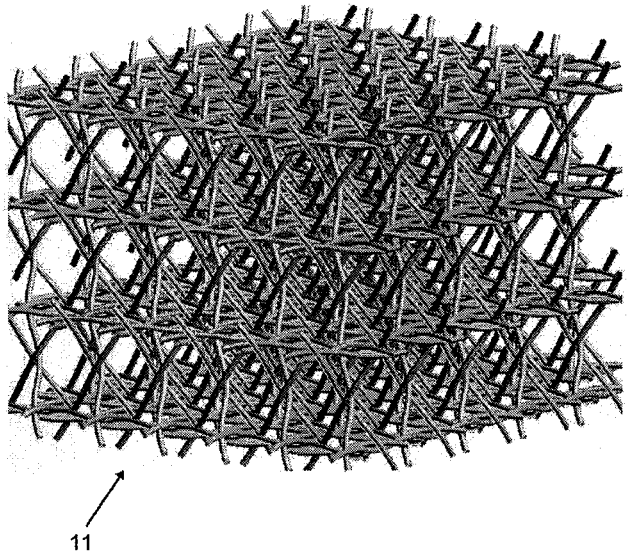

FIG. 9 shows a three-dimensional Kagome truss aggregate, which is constructed with wires in the above-described manner. It shows a three-dimensional truss-type cellular light structure 11, in which the unit cell of FIG. 7 or FIG. 8 is repeatedly combined.

Figure 10:
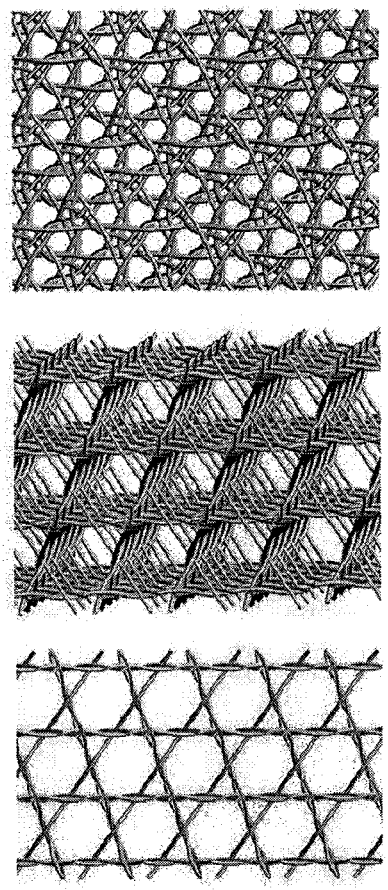

As shown in FIG. 10, the three-dimensional cellular light structure 11 of the Kagome truss type appears differently depending on the viewing direction. Particularly, the figure at the bottom of FIG. 10, as viewed from one of the six-dimensional wire groups, is substantially similar to the two-dimensional Kagome truss of FIG. 6. That is, the three-dimensional cellular light structure 11 is appeared as the same shape and pattern when seen along the axial direction of six wires, which are intercrossed with each other at the same angle (60 degrees or 120 degrees).

Figure 11:
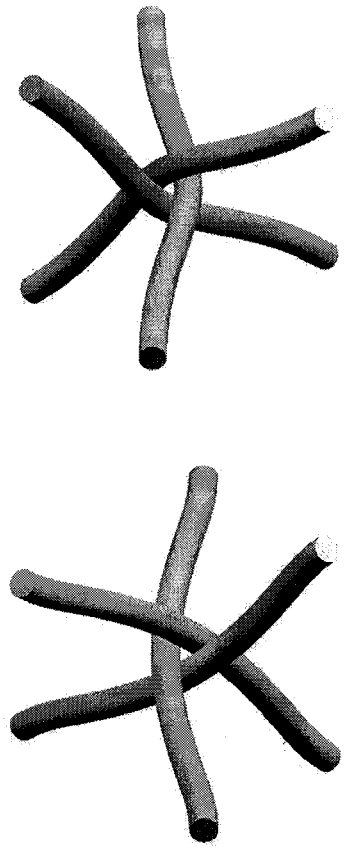

Each intersection point, at which three wires are intercrossed, corresponds to a vertex of the regular tetrahedron. As shown in FIG. 11, the wires are intercrossed in two difference modes when seen from the right front of the vertex. As illustrated respectively in the upper and lower figures of FIG. 11, the three wires may be intercrossed in such a manner to be overlapped clockwise or counterclockwise. In the case where the wires are intercrossed in a clockwise-overlapped pattern, the regular tetrahedron constituting a unit cell has a concave form as shown in the upper illustration of FIG. 12. If the wires are intercrossed in a counterclockwise-overlapped pattern, the regular tetrahedron constituting a unit cell has a convex form. Nevertheless, both cases may result in a cellular light structure, which is intended in the present invention and has a similar structure to the ideal Kagome truss or the Octet truss as described below. Now, a method for manufacturing the three-dimensional cellular light structure will be described.

Figure 41:
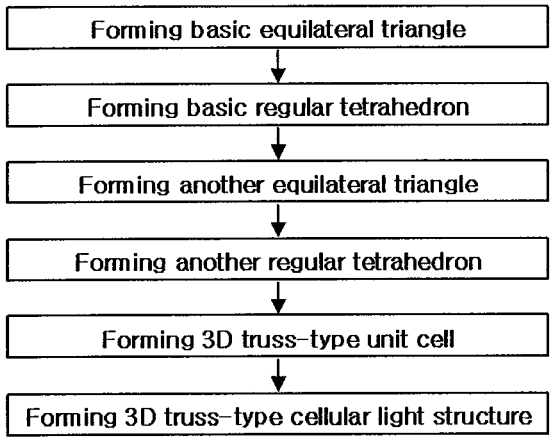
FIG. 41 is a flowchart outlining processes for manufacturing the three-dimensional cellular light structure formed of wires according to the earlier-filed invention.

FIG. 41 is a flowchart showing the manufacturing procedures of the three-dimensional truss-type cellular light structure formed of the wires according to the earlier-filed invention. According to the manufacturing method, a basic equilateral triangle is formed by intercrossing three wires 4, 5, and 6 in an X-Y plane. Then, a basic regular tetrahedron (a first regular tetrahedron) is constructed in such a manner that a wire 7 intercrosses the intersection point of the wires 5 and 6, a wire 8 intercrosses the intersection point of the wires 4 and 5, a wire 9 intercrossed the intersection point of the wire 6 and 4, the three wires 6, 9, and 7 are intercrossed so as to form an equilateral triangle, the three wires 4, 8, and 9 are intercrossed so as to form an equilateral triangle, and the three wires 5, 7, and 8 are intercrossed so as to form an equilateral triangle. Next, above the vertex of the first regular tetrahedron formed by the wires 4 to 9, another basic equilateral triangle is formed by intercrossing three wires 4', 5', and 6', each of which has the same orientation as the wire 4, 5, and 6 respectively. Thereafter, another regular tetrahedron (a second regular tetrahedron) is constructed in such a manner that the three wires 4', 8, and 9, the three wires 5', 7, and 8, and the three wires 6', 9, and 7 respectively are intercrossed so as to form an equilateral triangle. Accordingly, at both sides of the intersection point (vertex) formed by the three wires 7, 8, and 9, the first regular tetrahedron (formed by the wires 4, 5, 6, 7, 8, and 9) and the second regular tetrahedron (formed by the wires 4', 5', 6', 7, 8, and 9 are constructed to face each other and form a unit cell. In the same way as above, the wires are disposed such that an opposing tetrahedron can be formed at other vertexes of the first regular tetrahedron formed by the six wires 4 to 9, and thus a plurality of unit cells can be repeatedly formed to thereby fabricate a three-dimensional cellular light structure. In this case, the first and second regular tetrahedrons have a similar shape. In the case where the similarity ratio thereof is 1:1, they form a structure similar to the Kagome truss. If the similarity ratio is much higher than 1:1, they come to make a structure similar to the Octet truss as described above.

An embodiment of the present invention will be hereafter described in detail with reference to FIGS. 13 through 39 and 42.

Figure 13:
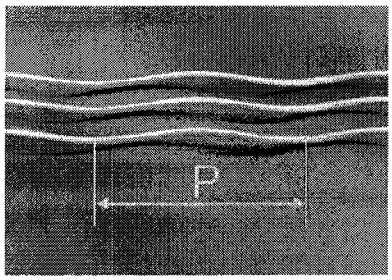
FIGS. 13 through 39 show an embodiment of the present invention.
Figure 14:
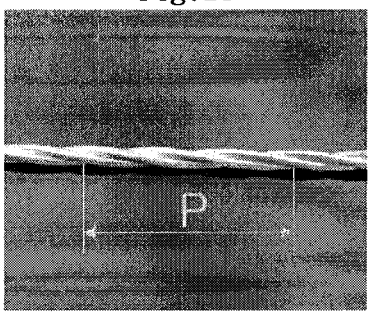
Figure 15:
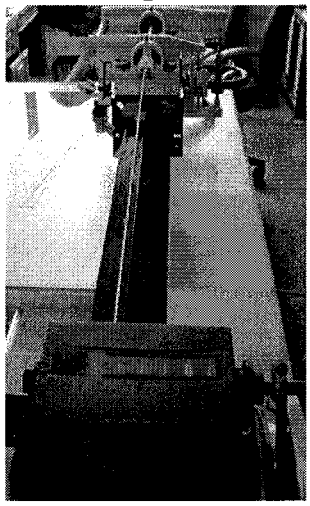

FIG. 13 is a picture of a helical wire; FIG. 14 is a picture of a plurality of wires twisted together by a twisting machine; and FIG. 15 is a picture of the twisting machine for forming the helical wire.

Figure 16:
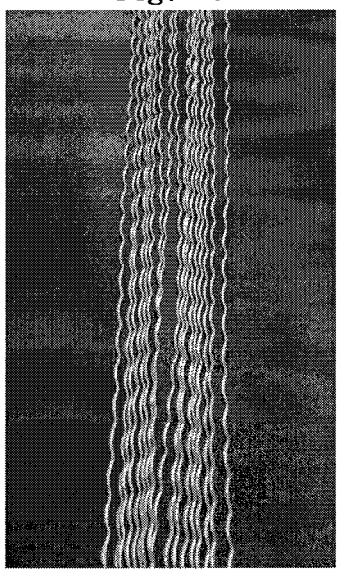
Figure 17:
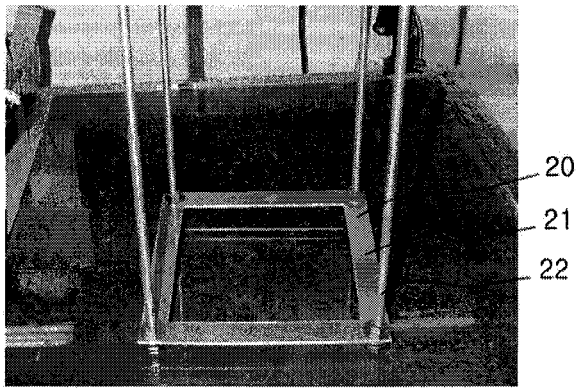
Figure 18:
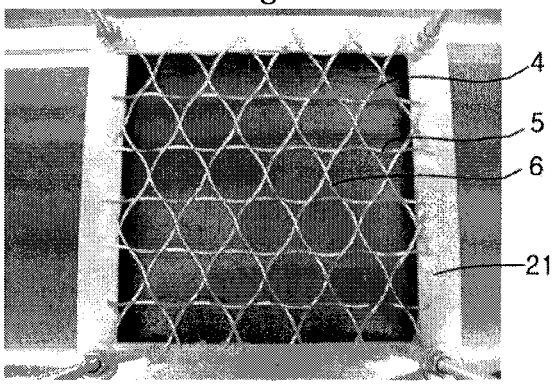
Figure 19:
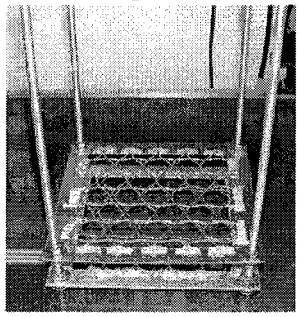
Figure 20:
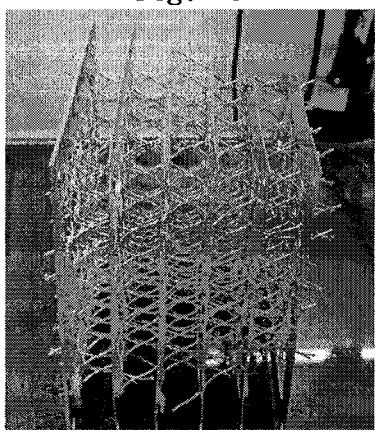
Figure 21:
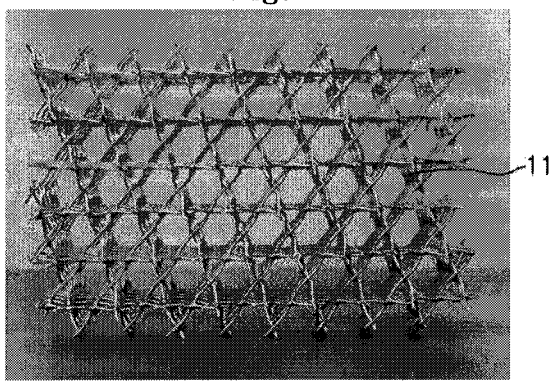

FIG. 16 is a picture of helical wires for the 1st, 2nd, 3rd, 4th, 5th, and 6th-axes; FIG. 17 is a picture of a frame assembly for assembling the helical wires; FIG. 18 is a picture showing the 1st, 2nd and 3rd-axis wires assembled on a frame of the frame assembly to form the two-dimensional Kagome plane; FIG. 19 is a picture showing two layers of the two-dimensional Kagome planes assembled on frames of the frame assembly; FIG. 20 is a picture showing the 4th, 5th and 6th-axis wires assembled with the two-dimensional Kagome planes; FIG. 21 is a picture of a completed three-dimensional cellular light structure with the frames removed.

Figure 22:
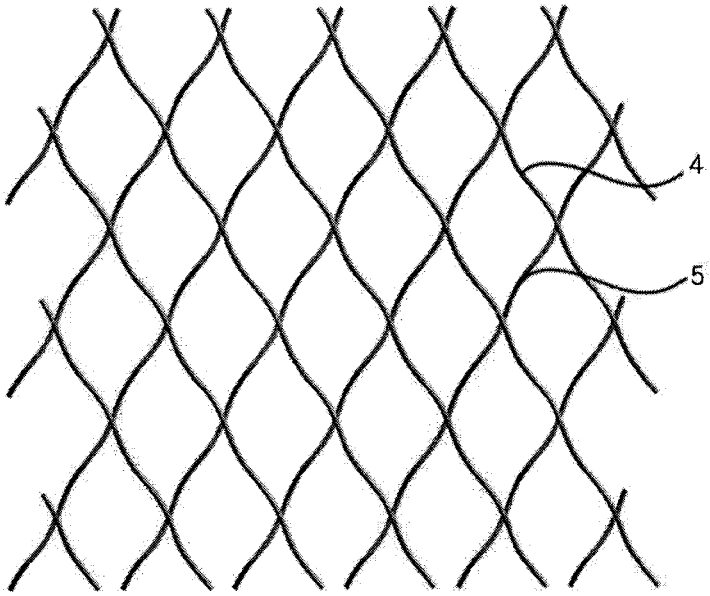
Figure 23:
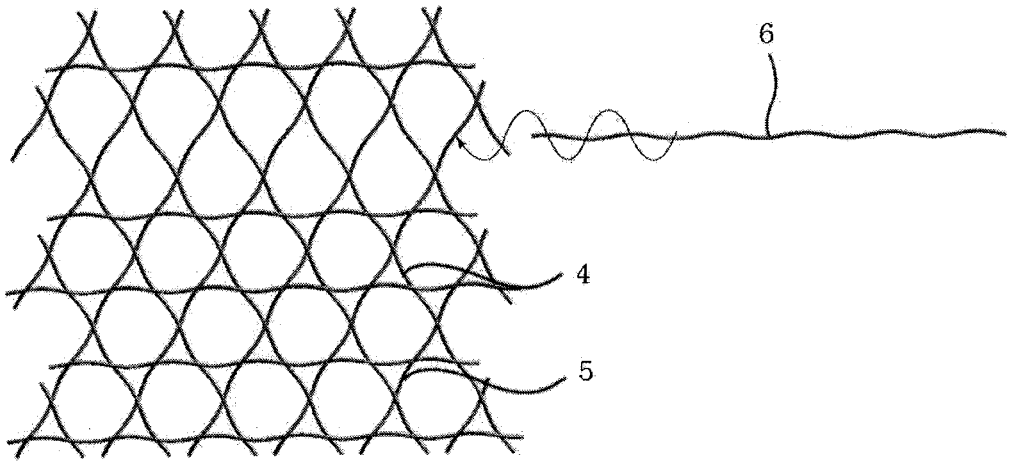
Figure 24:
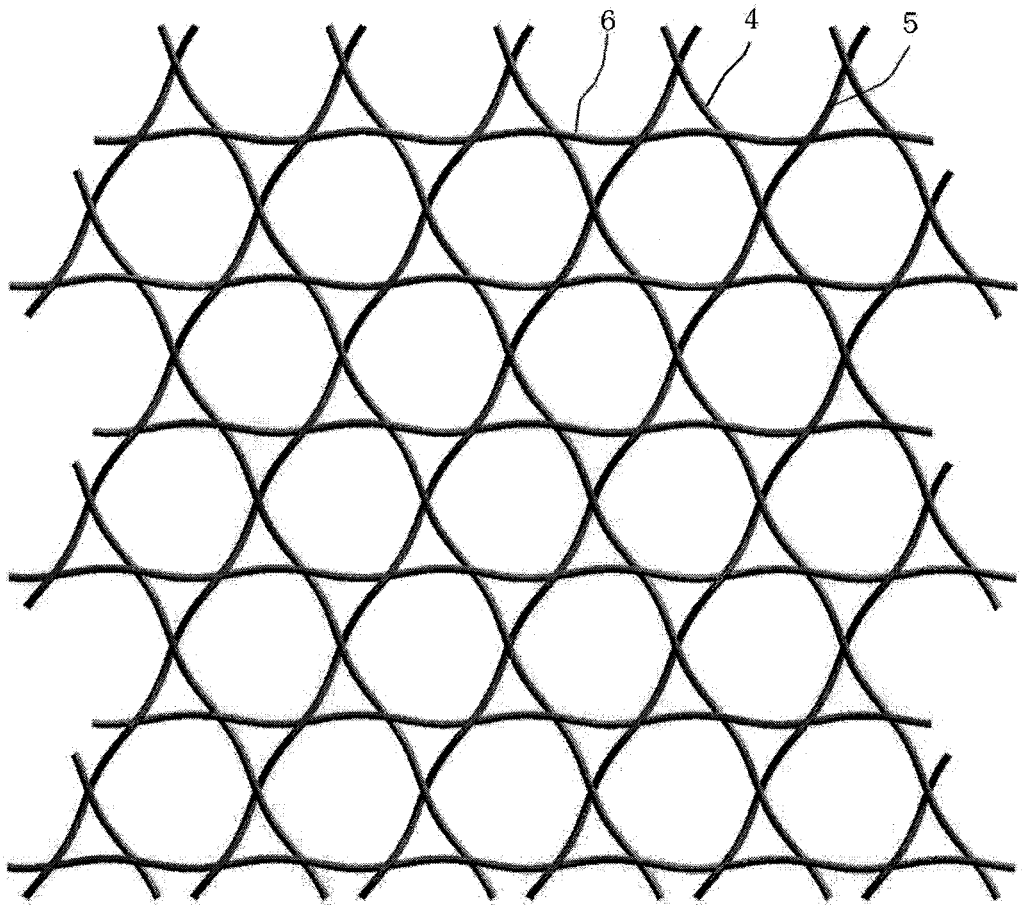
Figure 25:
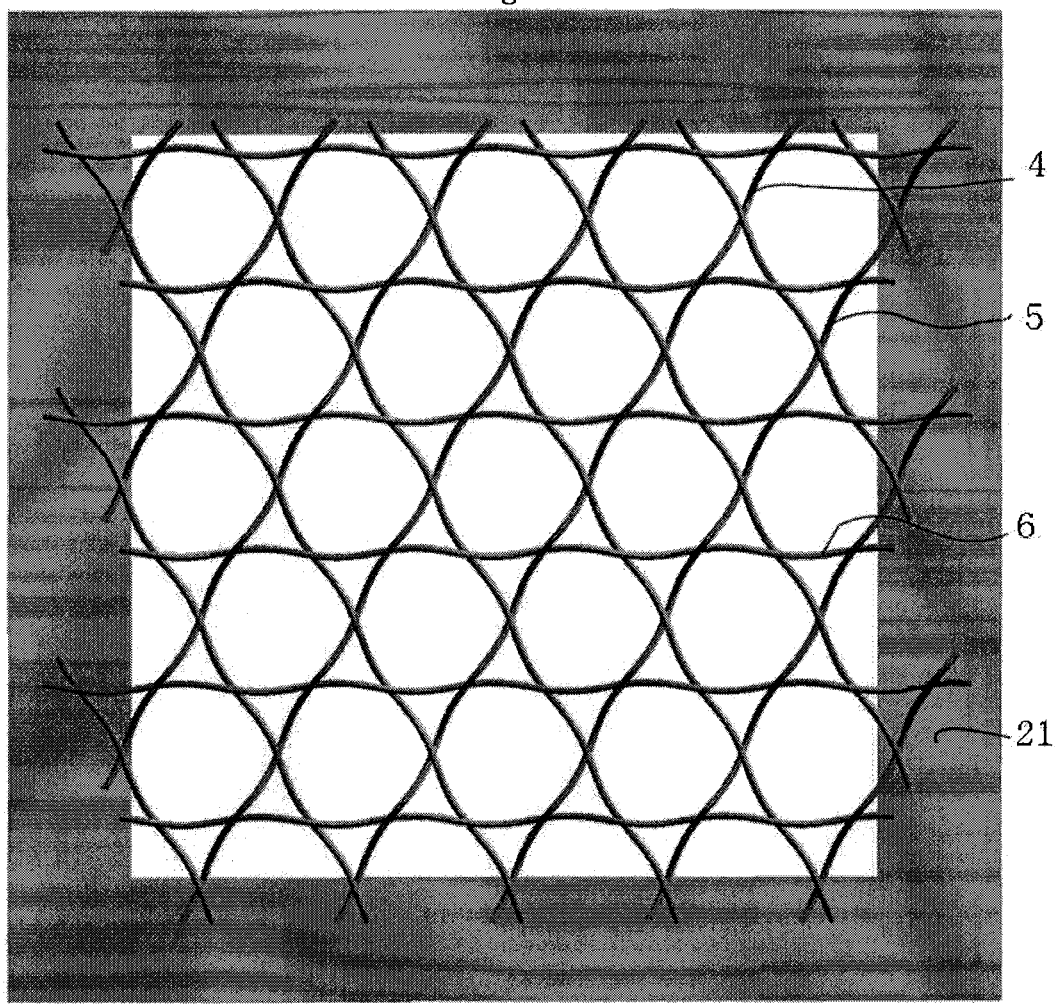
Figure 26:
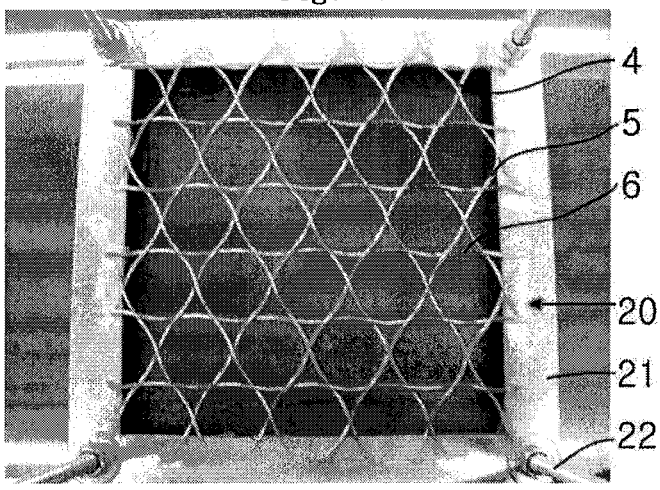
Figure 27:
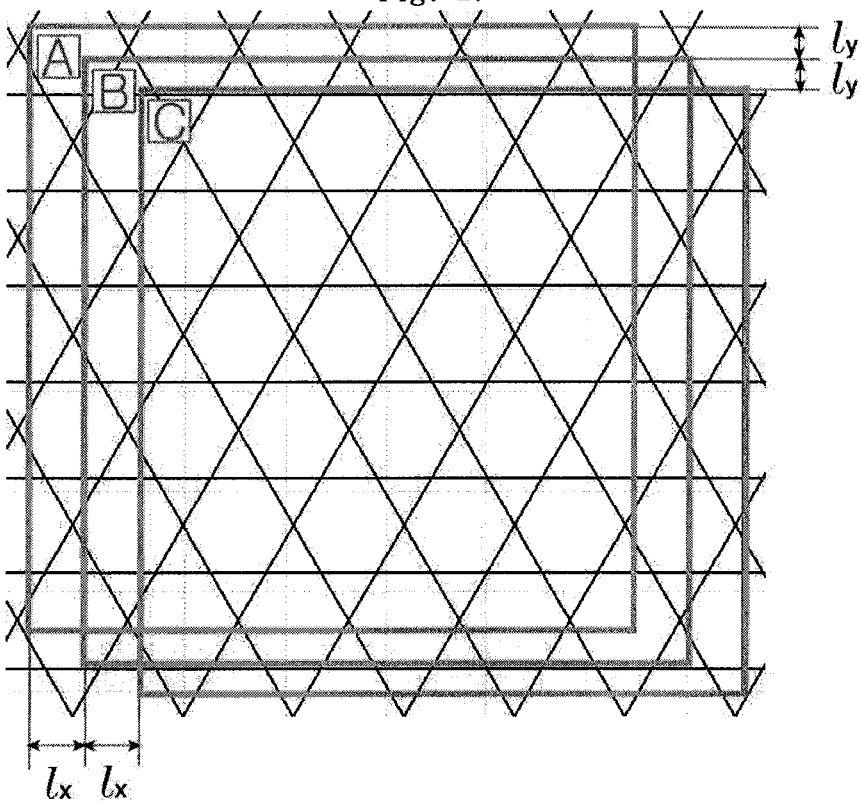
Figure 28:
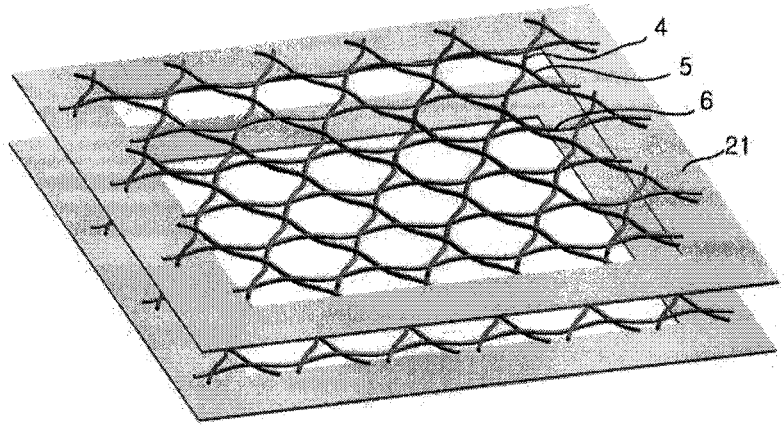
Figure 29:
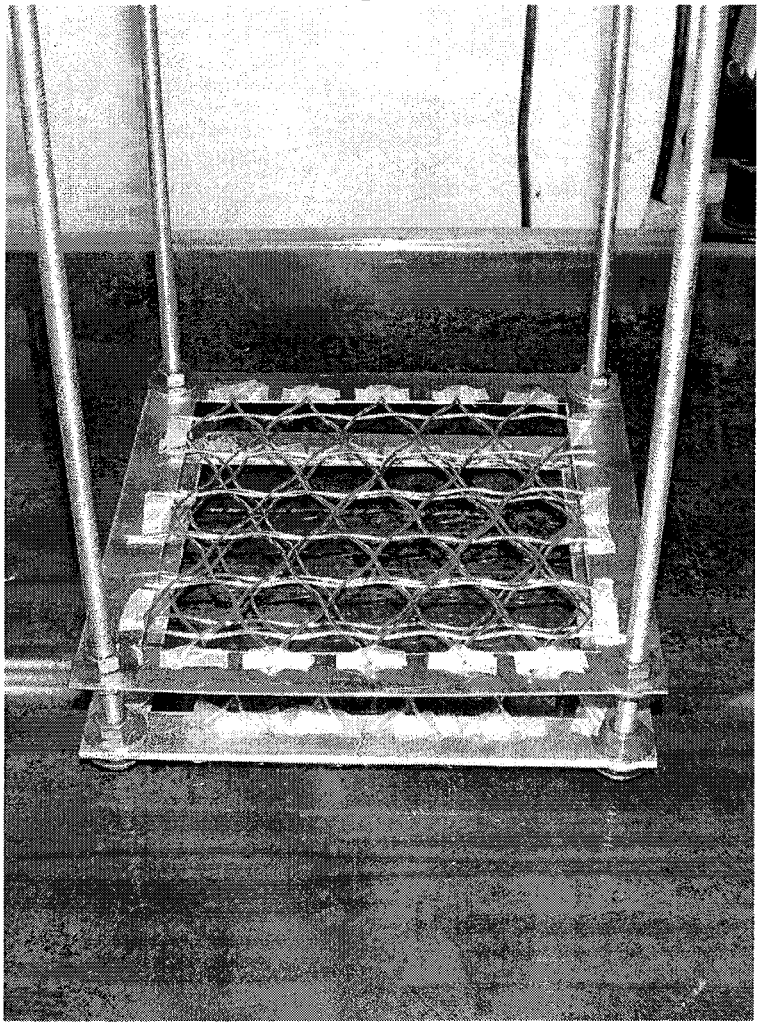
Figure 30:
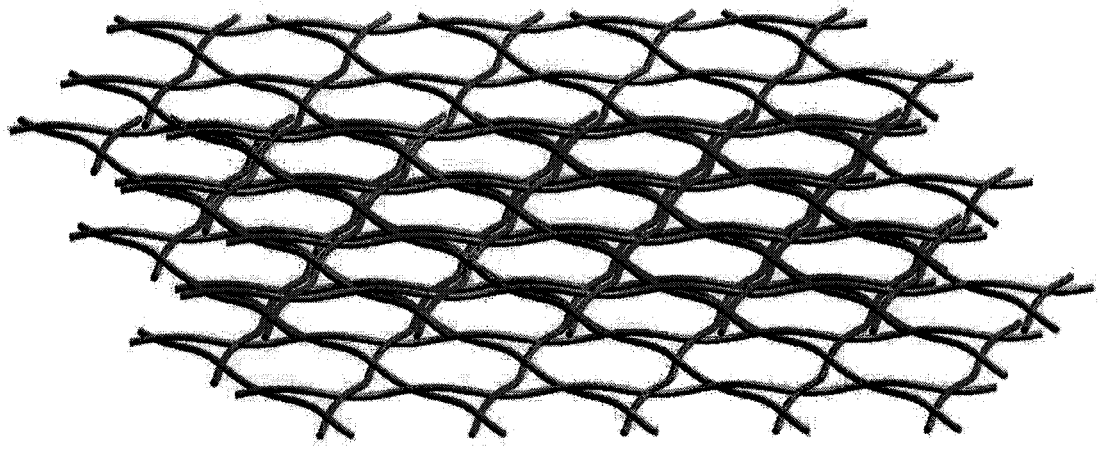
Figure 31:
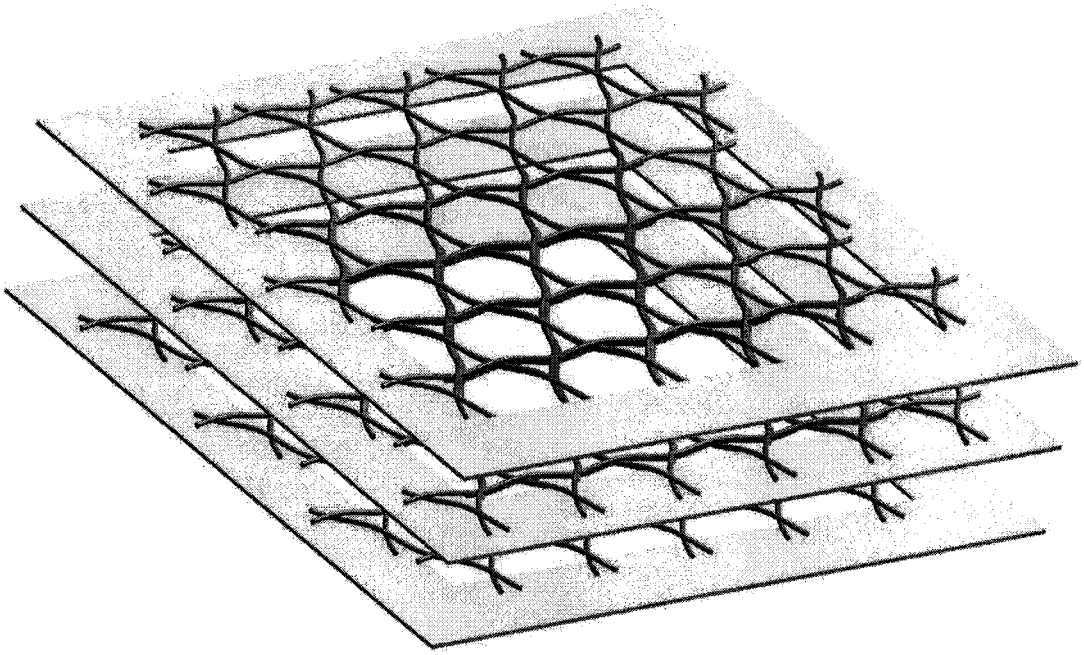
Figure 32:
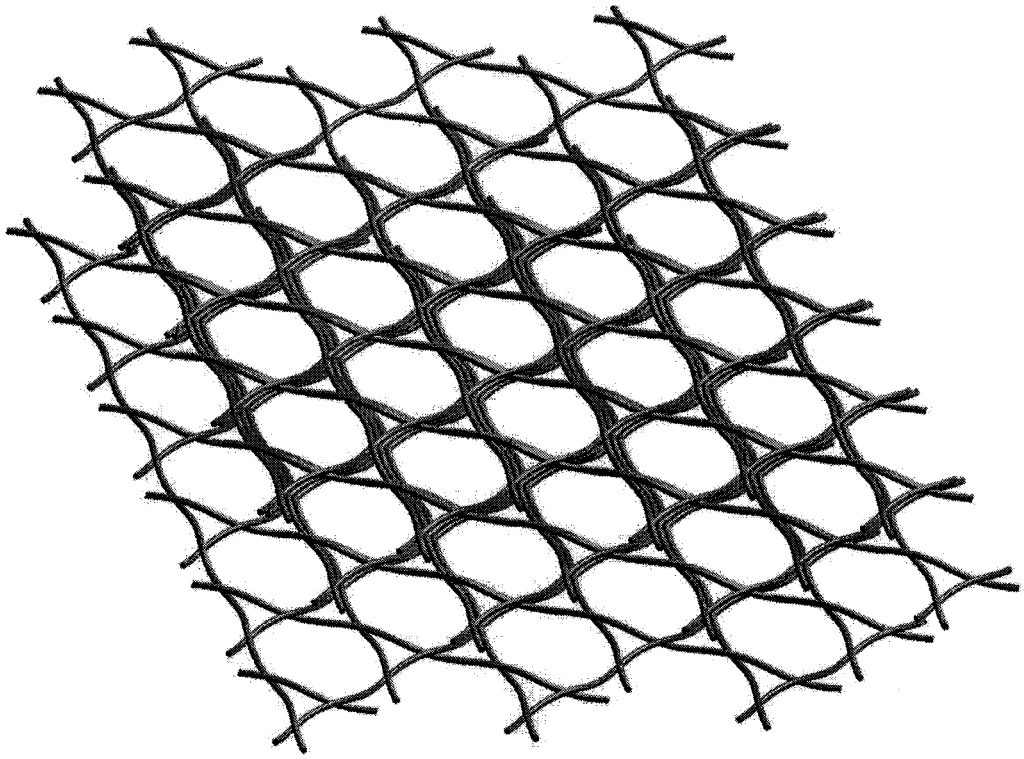
Figure 33:
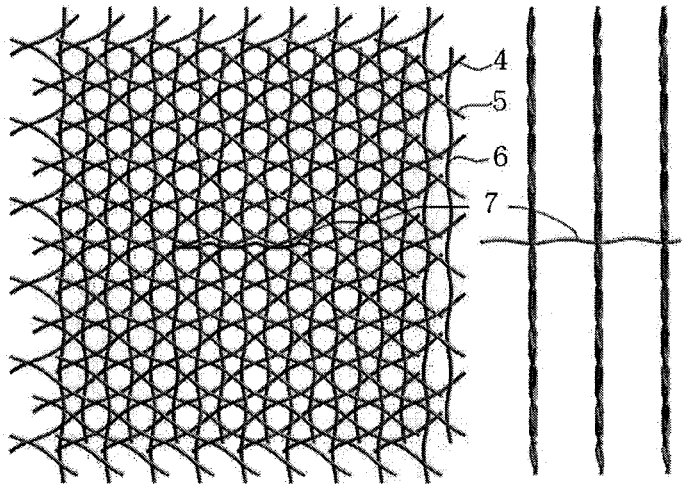
Figure 34:
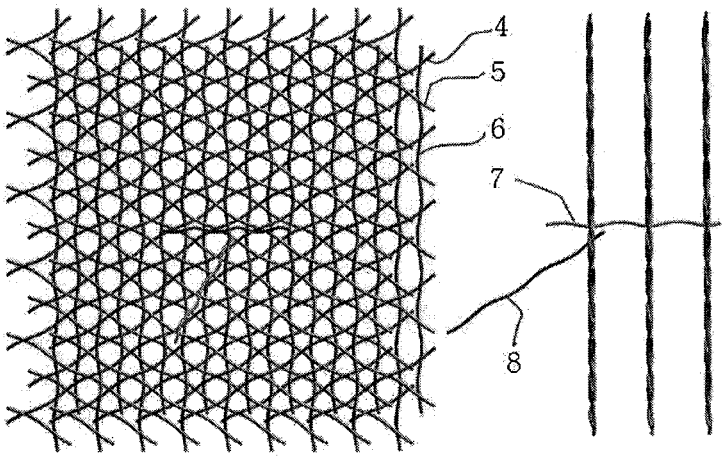
Figure 35:
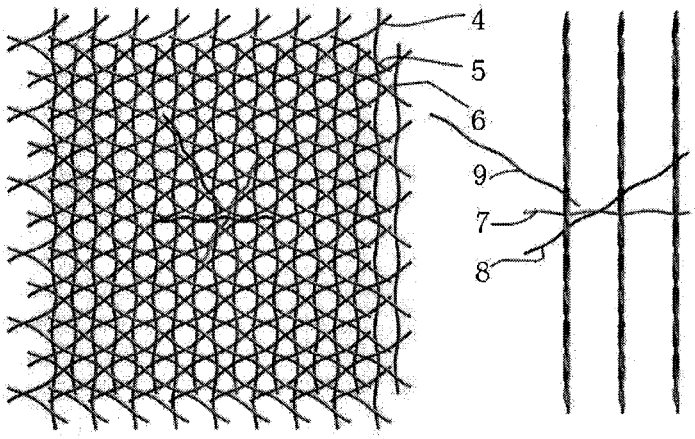
Figure 36:
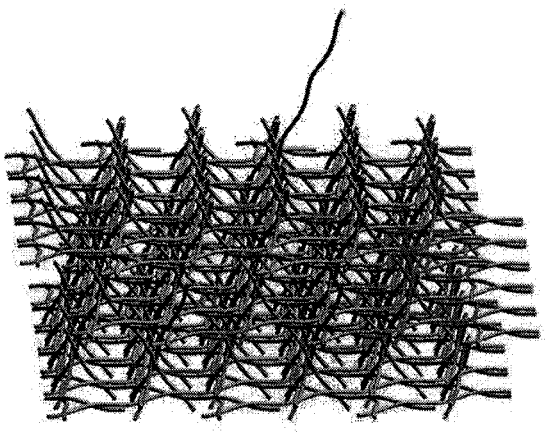
Figure 37:
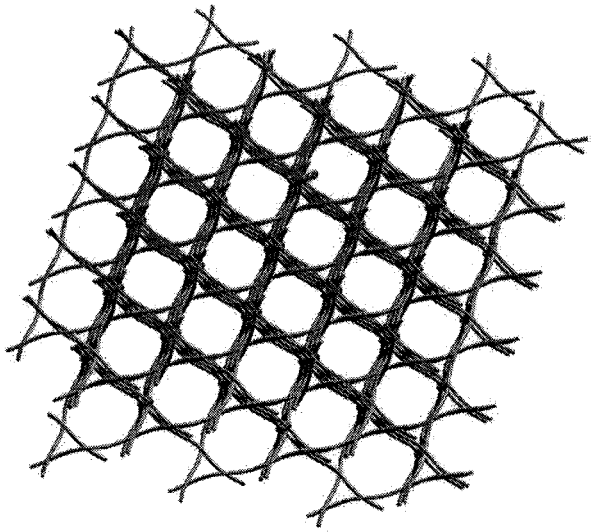
Figure 38:
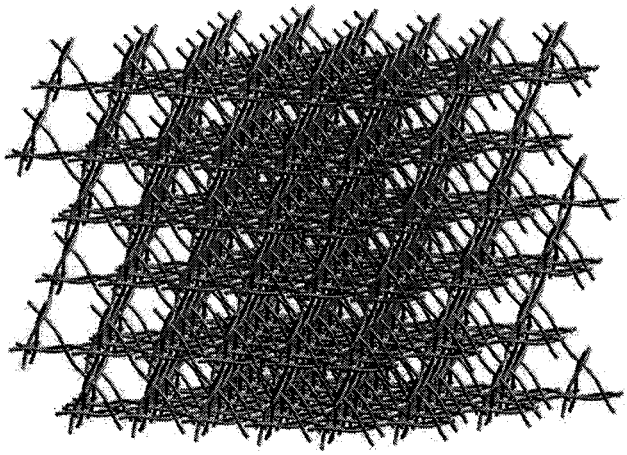
Figure 39:
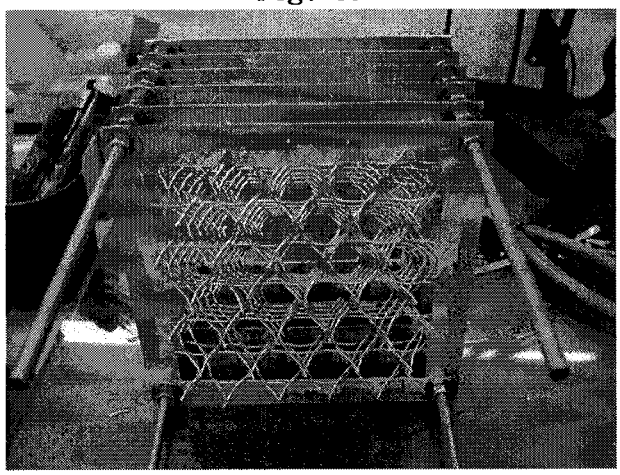
Figure 40:
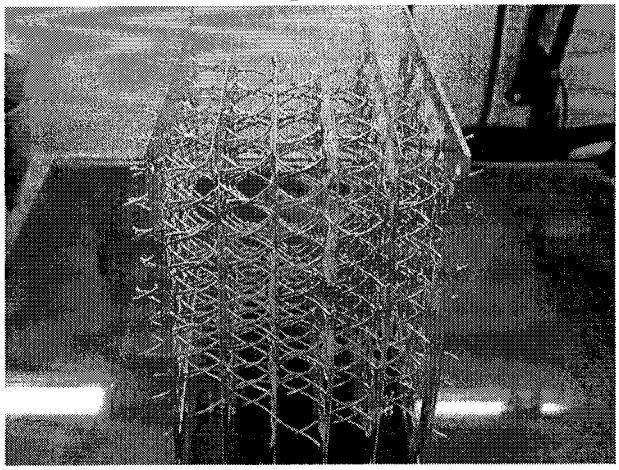

FIG. 22 is a plane view of the 1st and 2nd-axis wires, where the 1st-axis wires are first disposed and then the 2nd-axis wires are disposed to overlap; FIG. 23 is a plane view showing the step of assembling the 3rd-axis wires; FIG. 24 is a plane view of a single layer of the two-dimensional Kagome plane formed of the 1st, 2nd and 3rd-axis wires; FIGS. 25 and 26 are a plane view and a picture showing the single layer of the two-dimensional Kagome plane assembled to the frame; FIG. 27 is a plane view showing a method of laminating the two-dimensional Kagome planes of A, B, C layers; FIGS. 28 and 29 are a perspective view and a picture showing two layers of the two-dimensional Kagome plane with the frames; FIG. 30 is a perspective view of two layers of the two-dimensional Kagome plane with the frames removed; FIG. 31 is a perspective view of three layers of the two-dimensional Kagome plane with the frames; FIG. 32 is a perspective view of three layers of the two-dimensional Kagome plane with the frame removed; FIG. 33 is a plane view and a side view showing the step of assembling the 4th-axis wires with the 1st, 2nd and 3rd-axis wires in the two-dimensional Kagome planes; FIG. 34 is a plane view and a side view showing the step of assembling the 5th-axis wires with the 1st, 2nd, and 3rd-axis wires in the two-dimensional Kagome plane; FIG. 35 is a plane view and a side view showing the step of assembling the 6th-axis wires with the 1st, 2nd, and 3rd-axis wires in the two-dimensional Kagome plane; FIG. 36 is a perspective view showing the step of assembling the last wire of the six axes wires; FIG. 37 is a perspective view showing the step of assembling the last wire of the six axes wires, when seen from a moving direction of the last wire; FIGS. 38 to 40 are a perspective view or a picture of the final structure after the 1st, 2nd, 3rd, 4th, 5th and 6th-axis wires are completely assembled.

Figure 42:
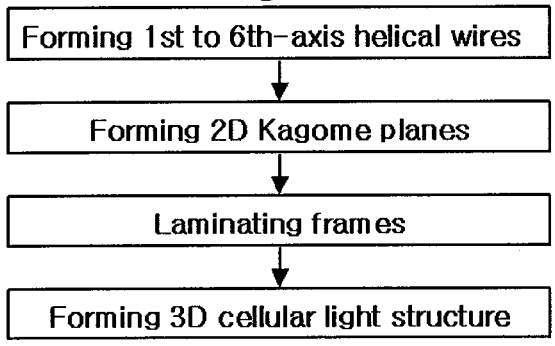
FIG. 42 is a flowchart out lining processes for manufacturing the three-dimensional cellular light structure formed of wires according to an embodiment of the present invention.

FIG. 42 is a flowchart outlining processes for manufacturing a three-dimensional cellular light structure according to another embodiment of the present invention.

A three-dimensional cellular light structure according to another embodiment of the present invention is constructed by wires 1, 2, 3, 4, 5, 6, 4', 5', 6', 7, 8 and 9 formed in a helical shape as shown in FIG. 13. That is, the six-axial wire groups for constructing the ideal Kagome truss or Kagome-like three-dimensional light structure according to the present invention are pre-fabricated in a helical shape. The amplitude and the pitch of the helical wires need to be determined so that the truss structure can be easily fabricated and three wires in different orientation can closely contact at each intersection point, thereby ensuring stability of the truss structure. For example, when the amplitude of the helical wire is too large, the truss structure can be easily fabricated but the overall truss structure may be loose because the wires do not closely contact at the intersection points. In this respect, it is preferred that the pitch of the helical wires is two times the length of the side of the regular tetrahedron constituting the unit cell of the truss structure.

The helical wires are formed by twisting a plurality of wires as shown in FIG. 14 using the twisting machine of FIG. 15. The pitch (P) of the helical wire can be adjusted according to the specification of the three-dimensional cellular light structure to be fabricated.

Yet, this method for forming the helical wires comprises a step of installing jigs at both sides of the twisting machine, a step of securely fixing both ends of two to four wires to the jigs, and a step of twisting the wires by the operation of the machine. According to this method, although the wires can be easily fabricated, its mechanism is too complicated and discontinuous to be applied to a machine for manufacturing a bulk Kagome.

Selectively, besides this method, a helical wire bending machine may be used or the helical wires may be formed by winding a wire around a rod having helical grooves. However, these methods have advantages and disadvantages, respectively. It is necessary to further develop an apparatus having a simplified structure, easy to operate, and suitable for continuous processes.

After the helical wires are prepared as shown in FIG. 16, the wires are used to form the two-dimensional Kagome planes. At this time, a frame assembly 20 comprising a rectangular frame 21 and connection support rods 22 is used, as shown in FIG. 17.

The 1st-axis wires 4 and the 2nd-axis wires 5 are disposed, and then the 3rd-axis wires 6 are rotated and inserted between the 1st-axis wires 4 and the 2nd-axis wires 5. For this step to be carried out, the 1st-axis wires 4 and the 2nd-axis wires 5 should be securely fixed, and thus the frame 21 plays an important role.

In addition, after the two-dimensional Kagome planes are formed, the 4th-axis wires 7 are inserted across the two-dimensional Kagome planes, and then 5th-axis and 6th-axis wires 8 and 9 are inserted while being rotated across the two-dimensional Kagome planes. Therefore, the frame is necessary to securely fix the two-dimensional Kagome planes.

FIG. 18 shows a two-dimensional Kagome plane fabricated by arranging the 1st-axis wires 4 and the 2nd-axis wires 5 on a frame 21 and inserting a 3-axis wire 6 while rotating the same.

FIG. 19 shows two layers of the two-dimensional Kagome planes assembled on frames of the frame assembly.

FIG. 20 shows the 4th, 5th and 6th-axis wires 7, 8 and 9 inserted across the two-dimensional Kagome planes.

FIG. 21 shows a completed three-dimensional cellular light structure with the frames removed.

Hereafter, the manufacturing procedures of the three-dimensional cellular light structure formed of the helical wires woven by means of the frame assembly 20 are described in more detail.

First, as shown in FIG. 22, the 1st-axis wires 4 are disposed, and then the 2nd-axis wires 5 are disposed so as to form rhombuses.

Next, as shown in FIG. 23, the 3rd-axis wires 6 are rotated and inserted between the 1-axis wires 4 and the 2-axis wires 5, so as to form a single layer of the two-dimensional Kagome plane.

FIG. 24 shows the single layer formed by the 1st-axis wires 4, the 2nd-axis wires 5 and the 3rd-axis wires 6.

While the frame assembly 20 is not shown in FIGS. 22 and 23 for simplicity of the drawings, the single layer is formed in the frame assembly 20 as shown in FIGS. 25 and 26.

FIG. 27 shows the arrangement of the wires in three successive layers of the two-dimensional Kagome planes, and each layer is designated as layer A, layer B and layer C. The wires in the layers A to C are arranged so that the position deviations of the wires in horizontal and vertical direction between two neighboring layers are $l_x$ and $l_y$, respectively. The frames 21 of the layers A to C may be rectangular or, if necessary, have other shapes.

Herein, $lx=P/2$, $ly=\sqrt{3}P/6$, P=wire pitch.

After the 1st, 2nd and 3rd-axis wires 4, 5 and 6 are arranged on the frame 21 of the frame assembly 20 as above-mentioned, the layers are disposed so that the height difference between two layers are constant ($H=\sqrt{3}P/3$, P=wire pitch), thereby forming the structure as shown in FIGS. 28 and 29.

FIGS. 31 and 32 show three layers disposed at a constant height difference ($H=\sqrt{3}P/3$).

As above, after the 1st, 2nd and 3rd-axis wires 4, 5 and 6 are disposed, the 4th-axis wires 7 are assembled as shown in the front view and the side view of FIG. 33, the 5th-axis wires 8 are assembled among the 1st, 2nd, 3rd and 4th-axis wires 4, 5, 6 and 7 as shown in the front view and the side view of FIG. 34. Then, the 6th-axis wires 9 are rotated and inserted among the 1, 2, 3, 4 and 5-axis wires 4, 5, 6, 7 and 8 as shown in the front view and the side view of FIG. 35.

FIG. 36 is a perspective view showing the step of assembling the last wire of the six axes wires, and FIG. 37 is a perspective view showing the step of assembling the last wire, when seen from a moving direction of the last wire;

FIGS. 38 and 39 show the final structure after the 1st, 2nd, 3rd, 4th, 5th and 6th-axis wires are completely assembled;

A method for manufacturing a three-dimensional cellular light structure according to another embodiment of the present invention comprises a helical wire forming step of forming 1st, 2nd, 3rd, 4th, 5th and 6th-axis helical wires 4, 5, 6, 7, 8 and 9; a two-dimensional Kagome plane forming step of forming a plurality of two-dimensional Kagome planes by assembling the 1st, 2nd and 3rd-axis helical wires 4, 5 and 6 on frames 21 of a frame assembly 20; a frame laminating step of connecting and laminating the frames 21 by means of connection support rods 22; and a step of forming a three-dimensional cellular light structure by connecting the 4th, 5th and 6th-axis helical wires 7, 8 and 9 to the 1st, 2nd and 3rd-axis helical wires 4, 5 and 6 in each frame 21.

The wire material of the three-dimensional truss-type cellular light structure is not specifically limited, but may employ metals, ceramics, fibers, synthetic resins, fiber-reinforced composite, or the like.

In addition, the intersection points among the above wires 4, 5, 6, 4', 5', 6', 7, 8 and 9 may be firmly bonded. In this case, the bonding means is not specifically limited, but may employ a liquid or spray adhesive, brazing, soldering, welding, and the like.

Furthermore, there is no limitation in the diameter of the wires and the size of the cellular light structure. For example, iron rods of tens of millimeters in diameter can be employed in order to construct a structural material for buildings, etc.

Figure 12:
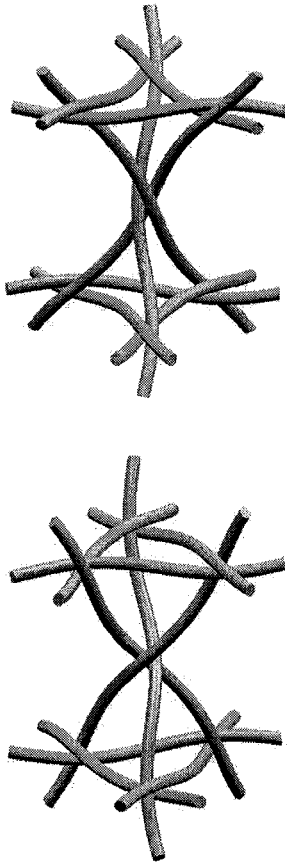

On the other hand, if wires of a few millimeters are use, the resultant cellular light structure can be used as a frame structure for fiber reinforced composite material. For example, using the three-dimensional cellular light structure of the invention as a basic frame, a liquid or semi-solid resin or metal may be filled into the empty space of the structure and then solidified to thereby manufacture a fiber reinforced composite material having a good rigidity and toughness. Furthermore, in the case where the three-dimensional cellular light structure of Octet type as shown in FIG. 12 is used, the smaller one of the two tetrahedrons constituting the unit cell may be filled with resin or metal to manufacture a fiber reinforced composite material. This fiber reinforced composite material is isotropic or almost isotropic and thus has uniform material properties regardless of its orientation. Therefore, it can be cut into any arbitrary shapes. Also, the wires are interlocked in all directions, thereby preventing damages such as delamination or pull-out of wires, which can occur in the conventional composite materials.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method for manufacturing a three-dimensional cellular light structure, comprising:

a helical wire forming step of forming 1st, 2nd, 3rd, 4th, 5th and 6th-axis helical wires, each of the helical wires being formed such that the pitch of the helical wires is two times the length of a regular tetrahedron which is a unit cell of the three-dimensional cellular light structure;

a two-dimensional Kagome plane forming step of forming a plurality of two-dimensional Kagome planes by assembling the 1st, 2nd and 3rd-axis wires on frames of a frame assembly;

a step of fabricating a three-dimensional cellular light structure by assembling the 4th, 5th and 6th-axis wires in out-of-plane directions on two-dimensional Kagome planes consisting of the 1st, 2nd and 3rd-axis wires in each frame.

2. A method for manufacturing a three-dimensional cellular light structure according to claim 1, wherein the 3rd-axis wires are rotated and inserted between the 1st and 2nd-axis wires.

3. A method for manufacturing a three-dimensional cellular light structure according to claim 1, wherein the 6th-axis wires are rotated and inserted among the 1st, 2nd, 3rd, 4th and 5th-axis wires.

4. A method for manufacturing a three-dimensional cellular light structure, comprising:

providing 1st, 2nd, 3rd, 4th, 5th and 6th-axis helical wires;

a two-dimensional Kagome plane forming step of forming each of a plurality of two-dimensional Kagome planes by assembling the 1st, 2nd and 3rd-axis wires on a rectangular frame assembly, each of the plurality of two-dimensional Kagome planes being formed by placing each of the 1st, 2nd and 3rd-axis wires so that they bridge a space between sides of the rectangular frame assembly;

a step of fabricating a three-dimensional cellular light structure by assembling the 4th, 5th and 6th-axis wires in out-of-plane directions on two-dimensional Kagome planes consisting of the 1st, 2nd and 3rd-axis wires in each frame.

5. A method for manufacturing a three-dimensional cellular light structure according to claim 4, wherein the 3rd-axis wires are rotated and inserted between the 1st and 2nd-axis wires.

6. A method for manufacturing a three-dimensional cellular light structure according to claim 4, wherein the 6th-axis wires are rotated and inserted among the 1st, 2nd, 3rd, 4th and 5th-axis wires.

* * * * *

UNITED STATES PATENT AND TRADEMARK OFFICE

CERTIFICATE OF CORRECTION

PATENT NO. : 8,418,730 B2
APPLICATION NO. : 12/516967
DATED : April 16, 2013
INVENTOR(S) : Kang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 712 days.

Signed and Sealed this
First Day of September, 2015

Michelle K. Lee

Michelle K. Lee
*Director of the United States Patent and Trademark Office*